US009663985B2

(12) United States Patent
Yocum et al.

(10) Patent No.: US 9,663,985 B2
(45) Date of Patent: May 30, 2017

(54) ARCHED WINDOW COVERING

(71) Applicant: Springs Window Fashions, LLC, Middleton, WI (US)

(72) Inventors: Traci Yocum, Middleton, WI (US); Nicole Atkinson, Middleton, WI (US); Cletis Swopes, Middleton, WI (US)

(73) Assignee: SPRINGS WINDOW FASHIONS, LLC, Middleton, WI (US)

( * ) Notice: Subject to any disclaimer, the term of this patent is extended or adjusted under 35 U.S.C. 154(b) by 0 days.

(21) Appl. No.: 15/072,033

(22) Filed: Mar. 16, 2016

(65) Prior Publication Data

US 2016/0273268 A1 Sep. 22, 2016

Related U.S. Application Data

(60) Provisional application No. 62/133,776, filed on Mar. 16, 2015.

(51) Int. Cl.
*E06B 9/262* (2006.01)
*E06B 9/24* (2006.01)

(52) U.S. Cl.
CPC ..... *E06B 9/262* (2013.01); *E06B 2009/2488* (2013.01); *E06B 2009/2627* (2013.01)

(58) Field of Classification Search
CPC ..... E06B 2009/2627; E06B 9/262
USPC ..... 160/84.07, 134
See application file for complete search history.

(56) References Cited

U.S. PATENT DOCUMENTS

| | | | | |
|---|---|---|---|---|
| 4,934,434 | A * | 6/1990 | Schnebly | E06B 9/24 160/134 |
| 5,002,112 | A | 3/1991 | Schnebly et al. | |
| 5,765,619 | A | 6/1998 | Arnold | |
| 6,029,733 | A * | 2/2000 | Xue | E06B 9/262 160/134 |
| 6,145,569 | A | 11/2000 | Shaw et al. | |
| 7,000,669 | B2 | 2/2006 | Hsu | |
| 7,490,653 | B2 | 2/2009 | Ying | |
| 9,175,510 | B2 | 11/2015 | Chen | |
| 2004/0188035 | A1* | 9/2004 | Abita | E06B 9/26 160/84.07 |
| 2005/0133168 | A1 | 6/2005 | Hsu | |
| 2006/0090859 | A1 | 5/2006 | Chhun et al. | |

FOREIGN PATENT DOCUMENTS

DE 4133985 C1 * 10/1992

* cited by examiner

*Primary Examiner* — Blair M Johnson
(74) *Attorney, Agent, or Firm* — Michael Best & Friedrich LLP

(57) ABSTRACT

An arched window covering comprising a panel (e.g., having a series of elongated cells) positioned in a fan arrangement defining a central space near a center of rotation of the fan arrangement, a base positioned in the central space, and a support member supported by the base and positioned to provide support to the panel. Preferably, the arched window covering further comprises a rail secured to at least one of two ends of the panel. In one embodiment, the base defines an opening adapted to receive the support member. The support member preferably comprises an elongated member extending from the base toward a radially outer portion of the panel, and a spacer member supported by the elongated member and adapted to hold the elongated member spaced from the panel. In one arrangement, a position of the spacer member relative to the elongated member is adjustable.

17 Claims, 6 Drawing Sheets

ARCHED WINDOW COVERING

CROSS-REFERENCE TO RELATED APPLICATIONS

This application claims priority to U.S. Provisional Patent Application No. 62/133,776, filed on Mar. 16, 2015, and entitled "Cutdown Cellular Arch Shade," the contents of which is hereby incorporated by reference in its entirety.

BACKGROUND

The present invention relates generally to window coverings, and more particularly to window coverings for arched windows. The invention also relates to window coverings that can be cut to customer specified sizes in retail outlets.

Different approaches have evolved to prepare window coverings to be of the dimensions needed to cover a particular window or other architectural opening. Window coverings can be custom ordered in sizes determined by an installer or decorator. While custom ordering can ensure the desired fit when handled by professionals, there is a necessary time delay to order and receive the product. Custom ordering also can be expensive.

Another approach used in retail outlets is to stock only a limited number of sizes of window coverings and custom cut a stock size to the size requested by the customer. So called "size in store" programs have become popular in home improvement retail outlets. For the typical covering used on a typical rectangular window or other architectural opening, the "size in store" programs have been straightforward and successful.

Providing window coverings for arched windows presents unique difficulties. The window covering has a fan-like appearance, with a single rail along the bottom of the completed window covering. Both the top edge and the bottom edge of the window covering material are connected to opposite end portions of the bottom rail, so that the material is opened fan-like above the bottom rail. A decorative plug or cover can be used to conceal the semicircular opening defined at the inner edge of the arch formed by the fan shaped material. Because of the difficulty in appropriately sizing and assembling arched window coverings as known previously, manufacturers commonly have handled these as specialty products that must be custom ordered in the appropriate size.

Further, since the outer edge of the fan-like shade is unsupported, with the only stability provided along the base of the arch window covering, it can be difficult to retain the material in the desired vertical position. Ceiling fans and other air currents can cause the material to flutter, and age and humidity can cause the material to sag. Accordingly, various clips and fasteners have been developed and used to secure the outer edge of the arch shade material in the desired position. Unfortunately, such clips and fasteners can be difficult to install properly and can be unsightly.

There is a need for a better system to retain an arched window covering in the desired orientation. There is also a need to provide arched window coverings in a more cost-effective manner.

SUMMARY

The present invention provides an arched window covering comprising a panel (e.g., a cellular material having a series of elongated cells) positioned in a fan arrangement defining a central space near a center of rotation of the fan arrangement, a base positioned in the central space, and a support member supported by the base and positioned to provide support to the panel (e.g., positioned inside at least one of the elongated cells). Preferably, the arched window covering further comprises a rail secured to at least one (and preferably both) of two ends of the panel. In this arrangement, the base can engage the rail.

In one embodiment, the base defines an opening adapted to receive the support member. Preferably, the base defines multiple openings, and the support member comprises multiple support members, each support member being supported in one of the openings. The support member preferably comprises an elongated member extending from the base toward a radially outer portion of the panel, and a spacer member (preferably two spacer members spaced along a length of the elongated member) supported by the elongated member and adapted to hold the elongated member spaced from the panel. In one arrangement, a position of the spacer member relative to the elongated member is adjustable. Preferably, the spacer member is shaped to substantially match a shape of the elongated cell.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
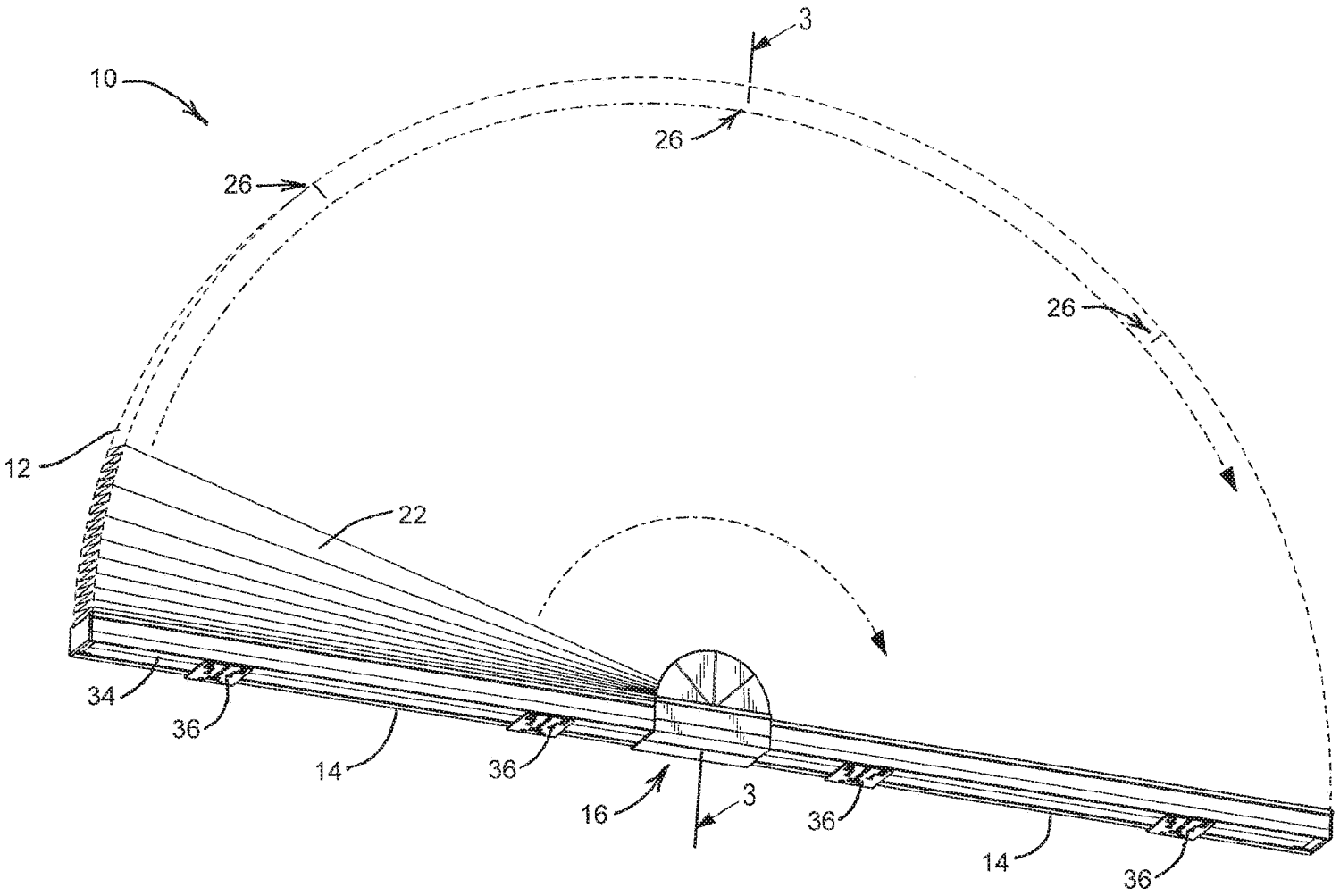
FIG. 1 is a perspective view of an arched window covering embodying the present invention.
Figure 2:
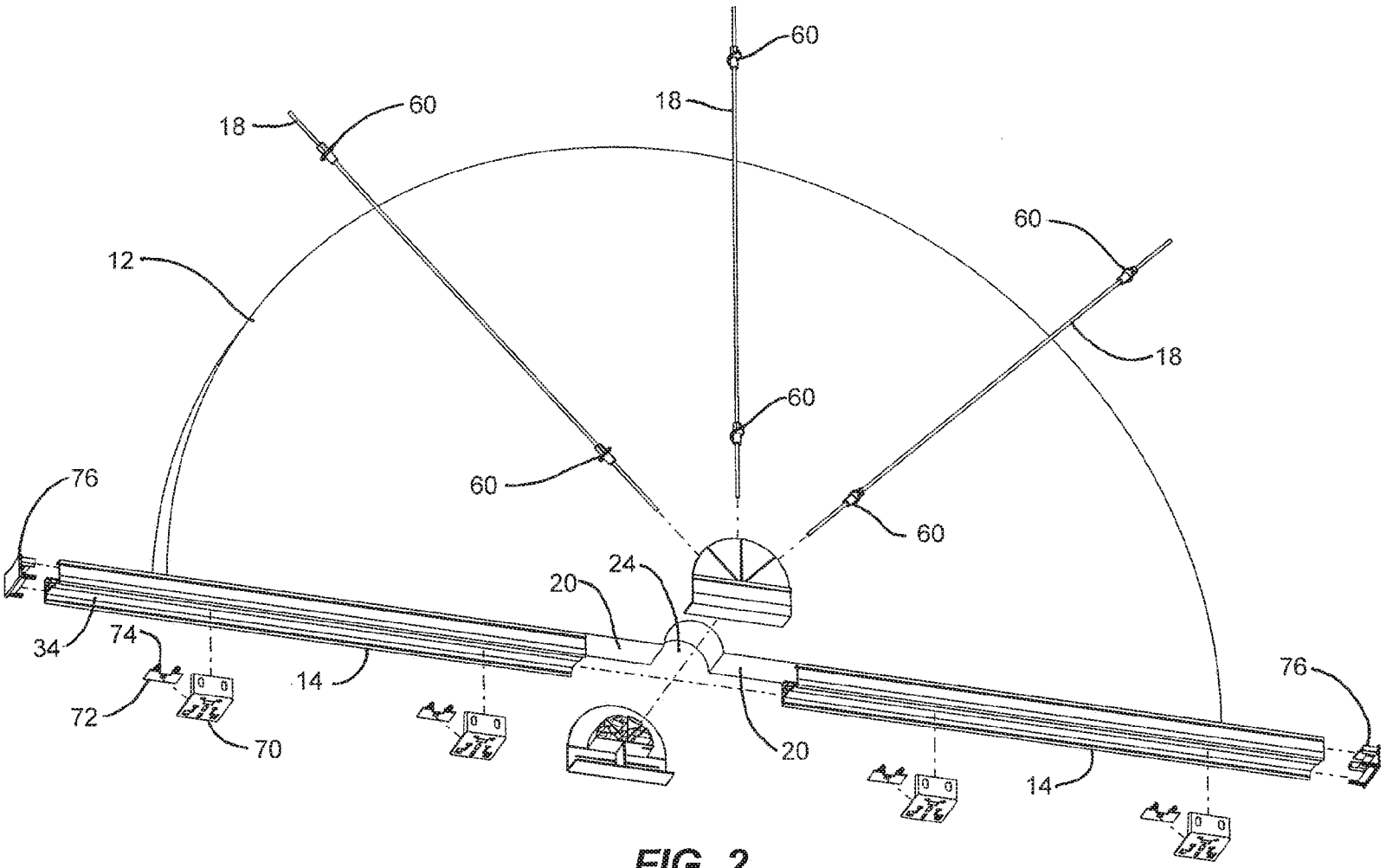
FIG. 2 is an exploded perspective view of the arched window covering of FIG. 1.

Referring to FIGS. 1-2, the illustrated arched window covering 10 includes a panel 12 of cellular material, two rails 14 secured to opposing ends of the panel 12, a base 16 positioned at the junction between the rails 14 and the panel 12, and a plurality of support members 18 supported by the base 16 and positioned inside the panel 12.

The illustrated panel 12 is made from a cellular fabric having two ends 20 and a series of hollow elongated cells 22 parallel to the ends 20, as is generally known in the window covering field. The hollow cells 22 allow for the insertion of the support members 18 inside the cells 22. It should be appreciated, however, that the concepts of the present invention are also applicable to panels made from other types of flexible materials, such as single layer fabrics, and multi-cell cellular materials. The illustrated panel 12 is designed to be positioned in a fan arrangement so that it can be used as a window covering 10 for an arched window. In the fan arrangement, the panel 12 defines a central space 24 near a center of rotation of the fan arrangement. Preferably, the panel 12 includes marked cells 26 with markings (e.g., inked lines or small slits) that indicate the cells through which the supports members should be inserted. In this way, the user is insured that the panel 12 is evenly fanned without the need to count cells or use trial and error to find the correct cells.

It should be understood that, while the panel 12 is illustrated in the figures in a fan arrangement with the ends of the panel 12 in a generally aligned position to each other, the panel 12 can also be arranged in a fully collapsed position (similar to a fully raised window blind) with the ends of the panel 12 parallel to and non-coaxial with each other. This collapsed position is preferred when cutting the panel 12 and rails 14 to the desired size and for packaging and shipping the window covering 10.

Each rail 14 defines an upper trough 28 (FIG. 5) for receiving the corresponding end of the panel 12. In the illustrated embodiment, the rails 14 further include opposed elongated lips 30 along opposing edges of the upper trough 28. The rails 14 are secured to the panel 12 by slats 32 inserted in the cells adjacent each end of the panel 12. With a slat 32 positioned in the last cell of the panel 12, the rail 14 can be slid longitudinally over the end of the slat 32 and panel 12, and the slat 32 provides a relatively stiff member that is held in the rail 14 by the opposing lips 30 on the rail 14. It should be understood that the rails 14 can instead be attached to the panel 12 in any suitable manner, such as with adhesive or fasteners. Each rail further includes a lower trough 34 adapted to receive and engage multiple mounting brackets 36, as described below in more detail.

Figure 7:
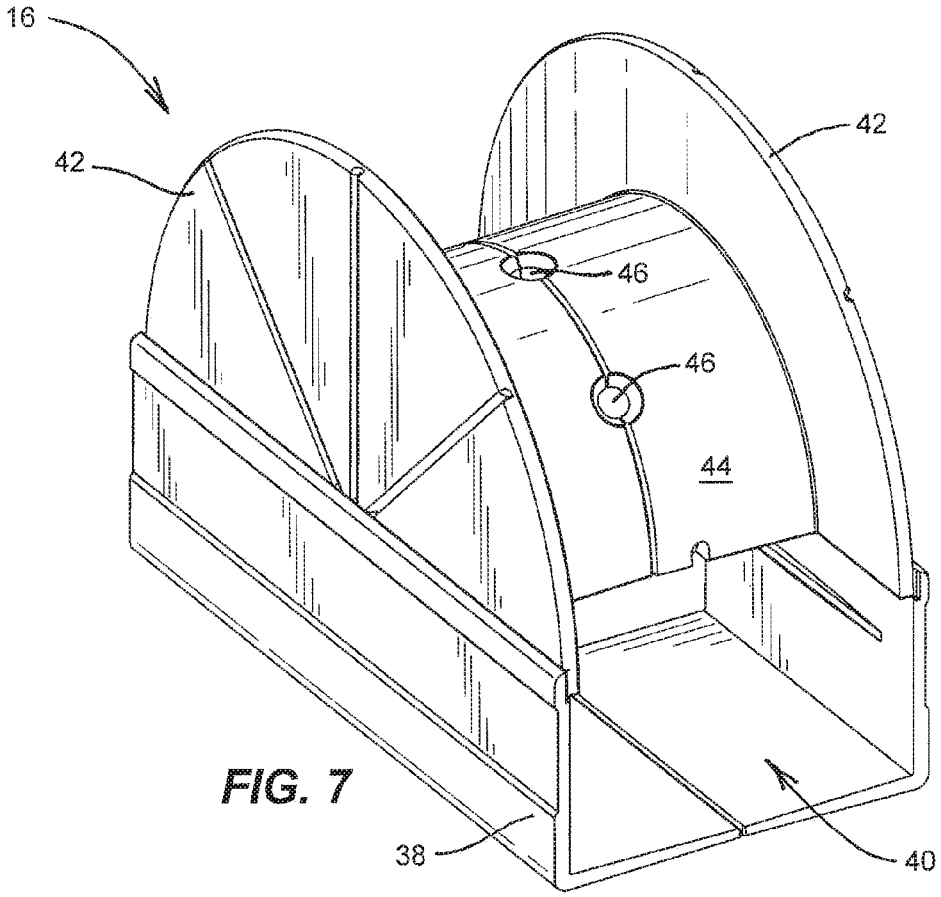
FIG. 7 is a perspective view of the center cap in an assembled condition.

Referring to FIG. 7, the illustrated base 16 includes a lower portion 38 defining opposed recesses 40 that are each dimensioned to receive an end of a corresponding rail 14. The base 16 further includes front and back semicircular flanges 42 supported by the lower portion 38 to provide an aesthetic cover over the central space 24 of the fanned panel 12. The base 16 further includes a semi-cylindrical stand 44 positioned above the lower portion 38 and between the semicircular flanges 42. The semi-cylindrical stand 44 includes a series of three circumferentially spaced, radial openings 46, each of which is adapted to receive a corresponding support member 18.

Figure 4:
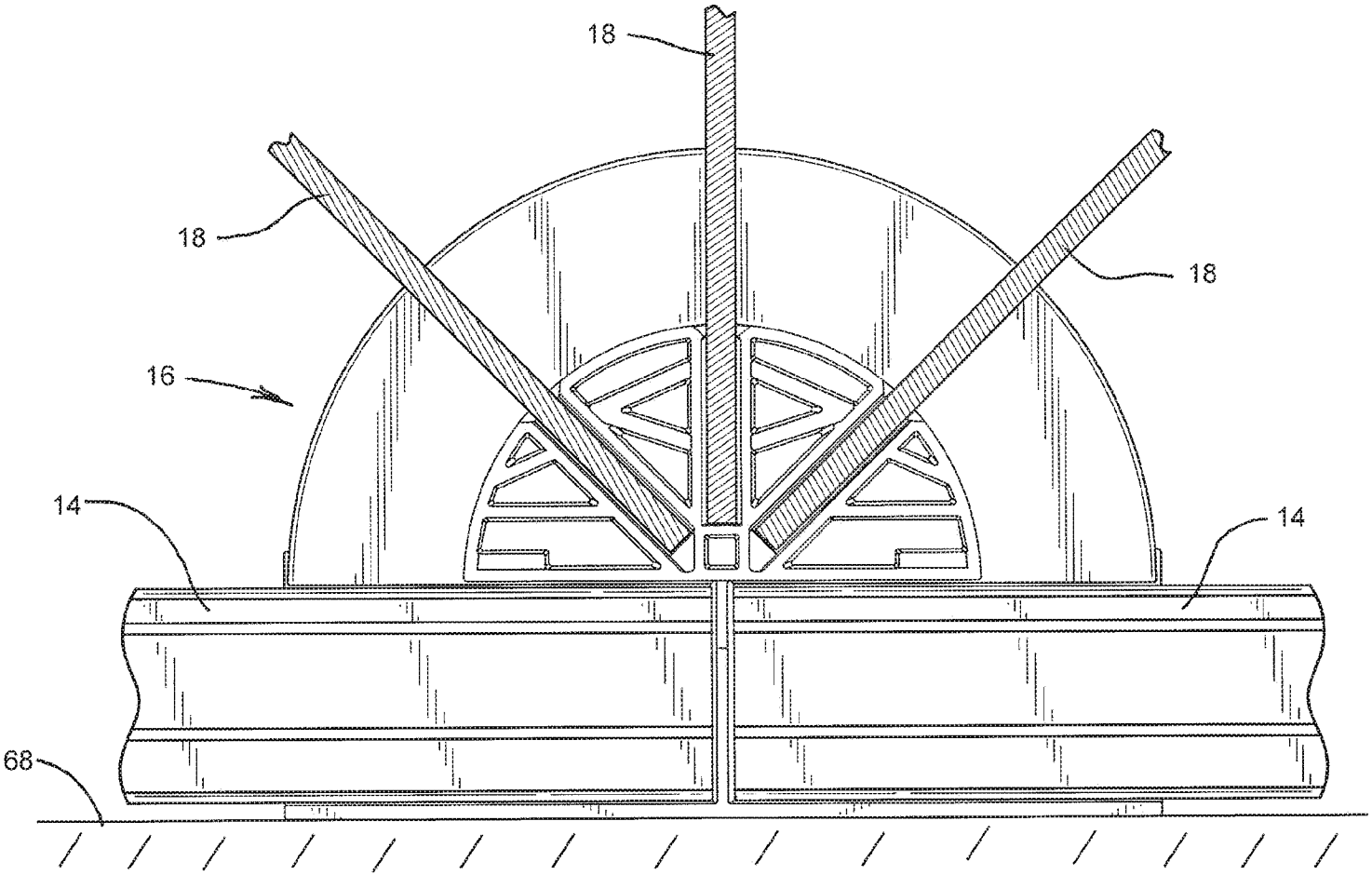
FIG. 4 is an enlarged front view of the section view of FIG. 3.
Figure 5:
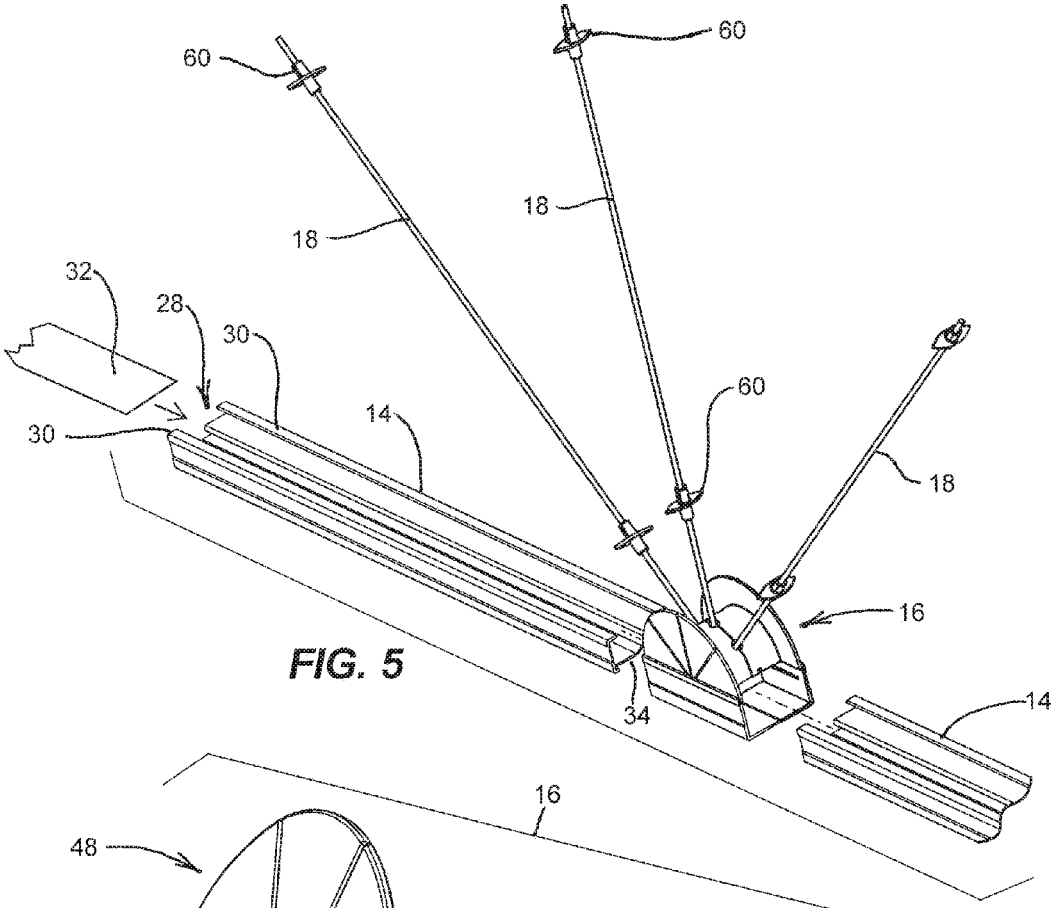
FIG. 5 is partially exploded perspective view of the arched window covering of FIG. 1 with cellular material and mounting bracket removed.
Figure 6:
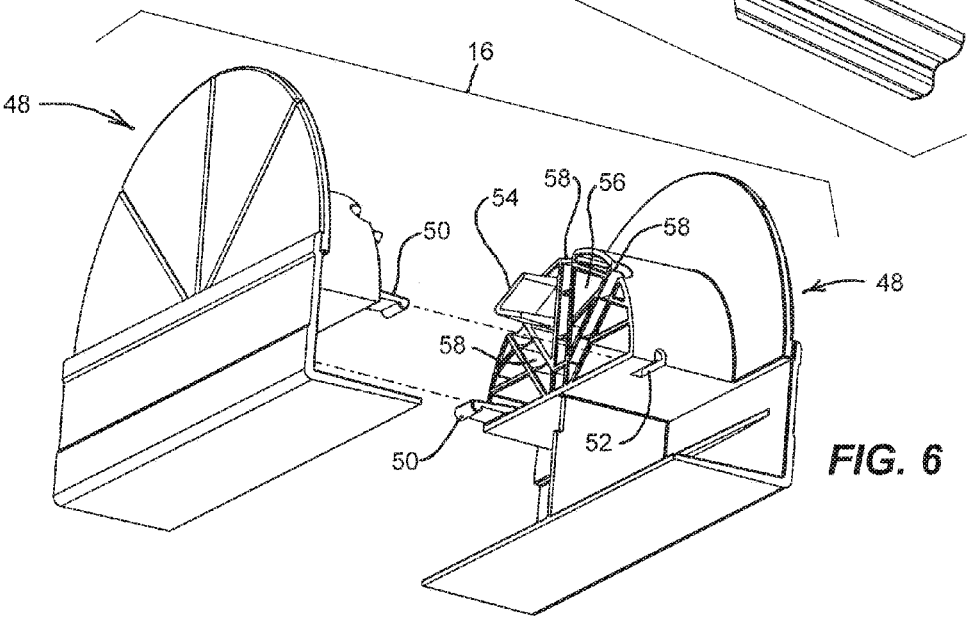
FIG. 6 is an exploded perspective view of a two-piece center cap that couples various components of the arched window covering.

Referring to FIG. 6, the illustrated base 16 is made from two identical parts 48, with each part 48 forming one of the flanges 42 and half of each of the lower portion 38 and semi-cylindrical stand 44. Each part 48 includes a latch 50 on one side of the part 48 and a corresponding detent 52 on the other side of the part 48 such that, when the two parts 48 are brought together, the latch 50 of one part 48 engages the detent 52 of the other part 48 to hold the two parts 48 together. In the illustrated embodiment, each detent 52 is formed as a slot in the base 16. Each part 48 further includes an alignment member 54 on one side and a corresponding alignment orifice 56 on the other side such that, when the two parts 48 are brought together, the alignment member 54 of one part 48 fits into the alignment orifice 56 of the other part 48 to ensure that the two parts 48 are properly aligned with each other. In order to define the radial openings 46, each part 48 includes three radial grooves 58, as best shown in FIGS. 4-6. The grooves 58 of one part 48 are positioned to match up with the grooves 58 of the other part 48 so that the grooves 58 cooperatively define the radial openings 46 of the base 16.

Figure 3:
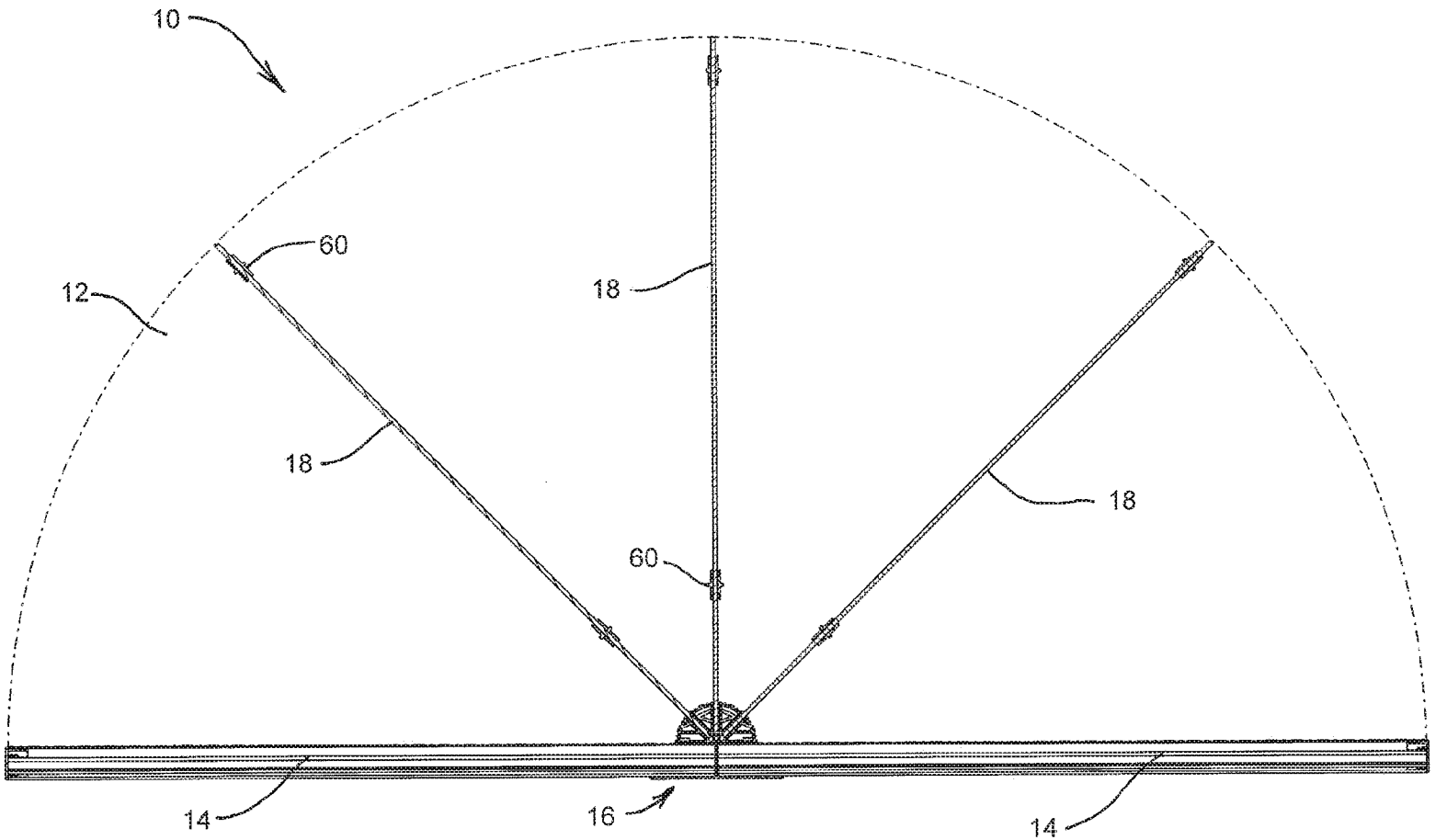
FIG. 3 is a vertical section view taken along line 3-3 in FIG. 1.
Figure 8:
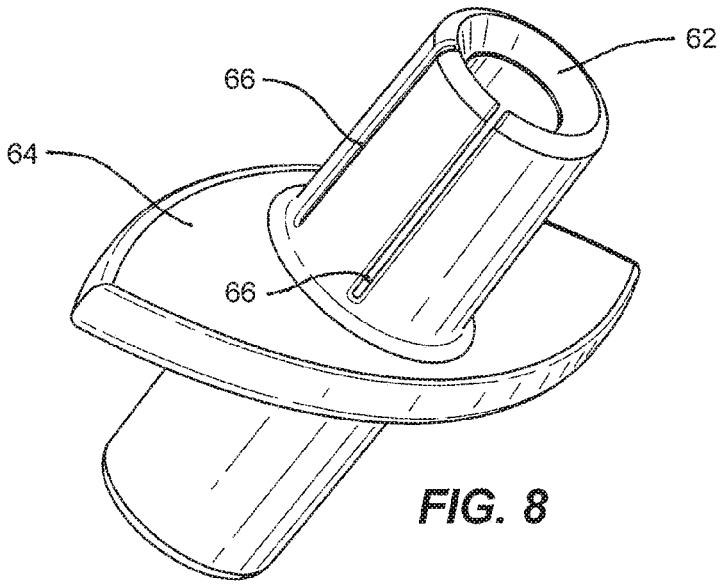
FIG. 8 is a perspective view of a spacer used in the embodiment of FIG. 1.

The illustrated support members 18 are essentially elongated rods that are dimensioned to fit inside the cells of the panel 12 and fit securely into the radial openings 46 in the base 16. Upon being inserted into the base 16, each of the rods will be held in the radially aligned positions illustrated in FIGS. 3-5. Each of the illustrated support members 18 includes two spacers 60 that are designed to hold the corresponding support member 18 spaced from the walls of the cellular panel 12. Referring to FIG. 8, each of the illustrated spacers 60 includes a body portion 62 adapted to be secured to the corresponding support member 18 and a spacer flange 64 adapted to establish and maintain a space between the support member 18 and the cellular panel 12. Preferably, the spacer flange 64 is shaped to match the shape of the cell 22 defined by the cellular panel 12. The illustrated body portion 62 includes two slits 66 that facilitate flexing of the body portion 62, which provides a frictional engagement between the spacer 60 and the corresponding support member 18 to thereby allow adjustment of the position of each spacer 60 relative to the corresponding support member 18. Alternatively, the spacer 60 can include other means for attaching to the support member 18 and allowing adjustment, such as a set screw in the spacer 60 or threading the interface between the spacer 60 and the support member 18 so that rotation of the support member 18 would adjust the position of the spacer 60 relative to the support member 18.

The illustrated mounting brackets 36 are designed to be secured (e.g., using screws) to a sill 68 of the window being covered by the arched window covering 10. Each mounting bracket 36 includes a mounting base 70, a mounting latch 72 movable relative to the mounting base 70, and springs 74 for biasing the mounting latch 72 to a latched position relative to the mounting base 70. The mounting latch 72 and mounting base 70 cooperatively work to engage the lower trough 34 of the rail 14, as is generally known in the art.

The arched window covering 10 of the present invention is designed to be customized to fit in arched windows of various sizes. Specifically, the panel 12 and rails 14 of the illustrated embodiment are designed to be provided in a size that can be cut down to the desired size. Such a cut down operation is performed on the panel 12 and rails 14 with the panel 12 in the collapsed position. Such a cut down operation is generally known for typical window coverings. After the panel 12 and rails 14 are cut down to the desired size, the end caps 76 are placed on the rails 14. The support members 18 would similarly be cut down to the desired length.

To mount the window covering 10 to the window, the mounting brackets 36 are first secured to the lower sill 68 of the arched window. With the rails 14 secured to the ends of the panel 12, the rails 14 are fanned away from each other to position the panel 12 in a fan arrangement. The two part base 16 is then assembled in the central space 24 to thereby sandwich the ends of the rails 14 and the radially inner side of the panel 12. Two spacers 60 are then secured at an appropriate location on each support member 18, and the resulting assemblies are inserted into the marked cells 26 in the panel 12 until the ends of the support members 18 are fully inserted into the corresponding openings 46 in the base 16. The resulting assembly of the rails 14, panel 12, base 16, and support members 18 is then positioned in the arched window by securing the rails 14 to the corresponding mounting brackets 36.

Various features and advantages of the invention are set forth in the following claims.

The invention claimed is:

1. An arched window covering comprising:

a panel positioned in a fan arrangement defining a central space near a center of rotation of the fan arrangement;

a base positioned in the central space; and a support member supported by the base and positioned to provide support to the panel, wherein the support member includes:

an elongated member extending from the base toward a radially outer portion of the panel, and a spacer member supported by the elongated member and adapted to hold the elongated member spaced from the panel.

2. An arched window covering as claimed in claim 1, wherein the panel comprises a cellular material.

3. An arched window covering as claimed in claim 1, wherein the panel has two ends, and where the arched window covering further comprises a rail secured to at least one of the two ends of the panel.

4. An arched window covering as claimed in claim 3, wherein the base engages the rail.

5. An arched window covering as claimed in claim 1, wherein the base defines an opening adapted to receive the support member.

6. An arched window covering as claimed in claim 1, wherein the base defines multiple openings, and wherein the support member comprises multiple support members, each support member being supported in one of the openings.

7. An arched window covering as claimed in claim 1, wherein the panel comprises a series of elongated cells.

8. An arched window covering as claimed in claim 7, wherein the support member is positioned inside at least one of the elongated cells.

9. An arched window covering as claimed in claim 1, wherein each support member includes two of the spacer members spaced from each other along a length of the elongated member.

10. An arched window covering as claimed in claim 1, wherein the spacer member is formed non-integrally from the elongated member.

11. An arched window covering as claimed in claim 1, wherein a position of the spacer member relative to the elongated member is adjustable.

12. An arched window covering as claimed in claim 1, wherein the spacer member is shaped to substantially match a shape of the elongated cell.

13. An arched window covering comprising:

a panel including a cellular material having a series of elongated cells; and a support member positioned inside at least one of the elongated cells to provide support to the cellular material, the support member comprising:

an elongated member; and a spacer member supported by the elongated member and adapted to hold the elongated member spaced from the cellular material.

14. An arched window covering as claimed in claim 13, wherein each support member includes two of the spacer members spaced from each other along a length of the elongated member.

15. An arched window covering as claimed in claim 13, wherein the spacer member is formed non-integrally from the elongated member.

16. An arched window covering as claimed in claim 13, wherein a position of the spacer member relative to the elongated member is adjustable.

17. An arched window covering as claimed in claim 13, wherein the spacer member is shaped to substantially match a shape of the elongated cell.

* * * * *